United States Patent [19]

McBurnett

[11] 3,975,909

[45] Aug. 24, 1976

[54] ENGINE SENSOR HYDRAULIC CONTROL SYSTEM

[75] Inventor: James R. McBurnett, Corinth, Miss.

[73] Assignee: Tyrone Hydraulics, Inc., Corinth, Miss.

[22] Filed: Feb. 26, 1975

[21] Appl. No.: 553,242

[52] U.S. Cl. ..... 60/421; 60/430; 60/431; 60/486; 91/412

[51] Int. Cl.[2] ..... F15B 18/00

[58] Field of Search ..... 60/420, 421, 426, 428, 60/430, 431, 459, 468, 486; 91/412

[56] References Cited

UNITED STATES PATENTS

| | | | |
|---|---|---|---|
| 2,616,264 | 11/1952 | Grant et al. | 91/412 |
| 2,797,551 | 7/1957 | Adams et al. | 60/426 |
| 3,535,877 | 10/1970 | Becker et al. | 91/412 X |
| 3,540,218 | 11/1970 | Finn | 60/428 X |

*Primary Examiner*—Edgar W. Geoghegan
*Attorney, Agent, or Firm*—Synnestvedt & Lechner

[57] ABSTRACT

The disclosure relates to plural, motor driven hydraulic pump circuits, including circuits having the pumps in at least one circuit operated in pairs with all pumps being driven by a single prime mover. A speed responsive control device unloads one pump in one circuit when engine speed drops below a predetermined value without regard to the source of the condition causing the slowdown. Also included is a crossover means for sensing the pressure in aother circuit for preventing reloading of the unloaded pump when speed rises above the predetermined value unless and until the pressure including the pressure sensed in the other circuit is below a predetermined pressure.

12 Claims, 4 Drawing Figures

89
84
87
70
81
82
70a
27
76
25
73
47
85
78
79
51
72
71
55
54b
68
69
54
53
58
54a
32
57
62
60
30
61
66
65
64a
56

ENGINE SENSOR HYDRAULIC CONTROL SYSTEM

RELATED APPLICATION

This application is related to copending application Ser. No. 452,713, filed Mar. 20, 1974, now U.S. Pat. No. 3,868,821 dated Mar. 4, 1975.

BACKGROUND OF THE INVENTION

The invention relates to hydraulic control systems useful for example, in controlling fixed displacement pumps wherein a plurality of pumps are provided for performing different functions, and especially to systems wherein some of the pumps in a circuit may be provided in pairs. The invention is especially useful in hydraulic systems used in heavy equipment such as earth-moving vehicles. An example is an excavator having an excavating bucket pivotally mounted on a stick which is in turn pivotally mounted on a boom. In such an excavator, a pair of pumps may be provided in a hydraulic circuit for operating hydraulic cylinders which move the stick and bucket and another pair of pumps may be provided in a second circuit having another pair of cylinders for operating the boom. In addition, in such equipment, the pumps may be used for other functions. For example, pumps in one of the circuits may also operate one track of the vehicle and the pumps in the other circuit may operate the other track. All pumps are typically driven by the vehicle engine through a common gear box.

In prior art systems, the pumps are generally driven by the operator at a constant speed. As is recognized, the input horsepower required of the prime mover which drives all of the pumps rises linearly with the pressure in the circuits and when the pressure rises substantially, as may occur when an obstruction is encountered during a digging operation, the torque requirements imposed on the prime mover may exceed the available torque. When this occurs, the diesel or gasoline engine used as a prime mover will stall. In the prior art, various arrangements are provided for unloading a pump in a circuit when an overload condition is encountered in that circuit which might cause the engine to stall or to cause damage to the equipment.

In the above-identified copending application an improvement in prior systems is disclosed in which positive displacement pumps driven by a common prime mover are arranged in operating circuits in a "crossover" unloading arrangement so that a pump in one circuit will be unloaded in response to pressure in either or both circuits. With the system disclosed in the prior copending application, one or more pumps in a plurality of circuits may be unloaded in response to pressure in one or more of the circuits so as to prevent the sum of the horsepower requirements from exceeding rated horsepower.

In certain applications, as for example in backhoes and various other kinds of excavators or earth-movers, it is desirable to allow the operator to exceed rated horsepower of the prime mover for short periods of time. In use of equipment not provided with pressure responsive unloading means, skilled operators recognize that they can exceed rated horsepower for short periods of time when encountering heavy or unusual loading conditions owing to the available flywheel or inertial energy of the prime mover. Thus, a skilled operator of manual equipment may rapidly break through an obstruction without stalling the prime mover whereas with the usual apparatus equipped with load sensing means, the operator will be unable to do so or may not be able to complete the job as rapidly since the pressure responsive mechanism will operate to prevent him from operating in a manner which results in rated horsepower being exceeded.

SUMMARY AND OBJECTS OF THE INVENTION

The present invention provides an engine responsive arrangement which is sensitive to overload conditions as represented by a reduction in flow of operating fluid and which allows the operator to utilize flywheel energy as he so desires and thereby exceed rated horsepower for short periods of time without unloading a pump. In common with the above-identified copending application, one embodiment of the present invention uses a crossover unloading arrangement. In the preferred embodiment of the present invention, a crossover arrangement is used to prevent reloading of a pump if the sum of the pressures in the circuits exceeds a predetermined value.

More particularly, the present invention provides a device for sensing fluctuations in engine or pump speed above and below a predetermined value. When the pump speed and hence engine speed drops below the predetermined value, as when the torque requirements imposed on the prime mover increase to a predetermined value, above which the prime mover may stall, a pump will be unloaded. The invention provides an extremely flexible unloading system for reloading the unloaded pump when the engine speed exceeds the predetermined value provided that the pressures imposed on the system are below a predetermined value. Thus, the invention provides a system which is pressure responsive in the unloaded mode only in the sense that the pressure responsive means will prevent reloading of a pump when engine speed exceeds a predetermined level if the sensed pressure indicates that this would result in unloading of the prime mover. Desirably, the pressures used to influence reloading may be derived from a plurality of sources, as for example, all hydraulic circuits which might produce an overload on the system. In a dual pump system, when both pumps of a dual pump package are in operation, both pumps will remain in the circuit and pressure in the circuit will have no influence on unloading so long as the speed remains above the predetermined value.

Accordingly, it is an object of the invention to provide an engine speed responsive system for unloading a pump in a hydraulic system.

Stated in another way, it is an object of the invention to provide a pump unloading control system which monitors all demands made on the prime mover driving the pump.

It is another object of the invention to unload a pump in a hydraulic system when speed drops below a set value and to provide a pressure override which prevents reloading of the pump if pressure in the hydraulic system is above a predetermined value.

A still further object of the invention is the provision of a speed responsive system for unloading pumps of a plural pump system which prevents reloading of any unloaded pump except when pump speed is above a predetermined value and hydraulic circuit pressures are below a predetermined value.

It is a still further object of the invention to provide an unloading system for a pump in a plural pump system which is not pressure responsive so long as engine speed remains above a predetermined value, thereby allowing an operator of equipment having the system to exceed rated horsepower for brief periods of time.

The above and various other objects of the invention are achieved in a hydraulic control system for an earth-moving vehicle or the like by the use of means for limiting the torque requirements imposed on the prime mover by loads encountered by said mechanism, comprising means for unloading a pump in response to a reduction in prime mover speed below a predetermined value and for only reloading the unloaded pump when load pressure is below a predetermined value.

DETAILED DESCRIPTION OF THE PREFERRED EMBODIMENT

Figure 1:
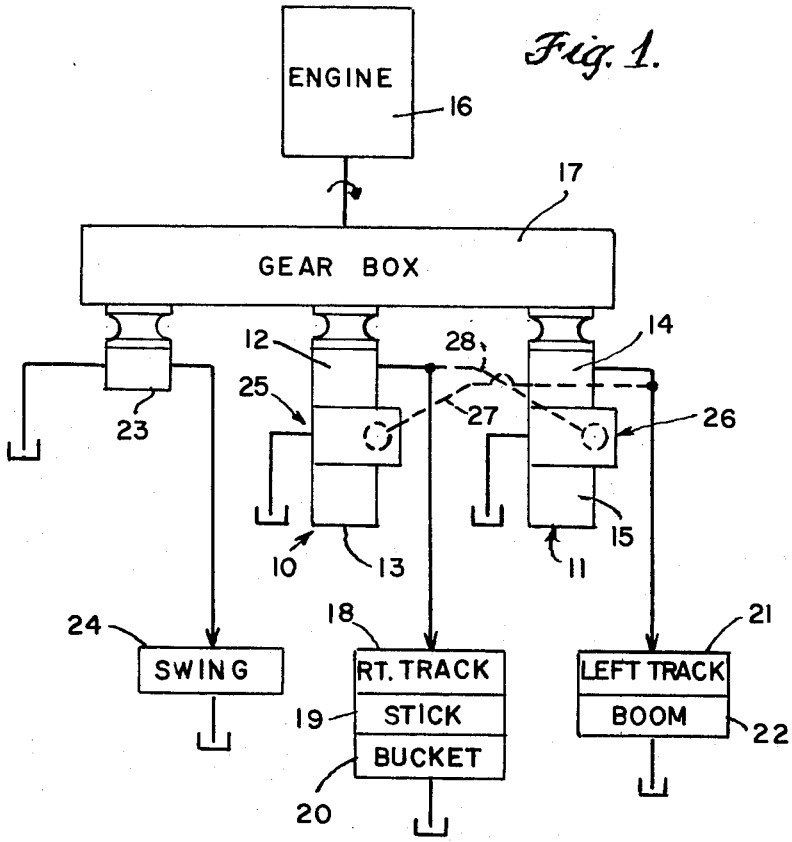
FIG. 1 is a schematic view of an excavator incorporating the principles of the present invention.

Turning first to FIG. 1, the hydraulic system in a preferred embodiment of the present invention typically comprises pump circuits 10 and 11, the pump circuit 10 including pump means comprising pumps 12 and 13, while the pump circuit 11 comprises pumps 14 and 15. A common prime mover 16 drives the pumps via a gear box schematically shown at 17. In the illustrative embodiment of the invention the combined output of pumps 12 and 13 is used, in an excavator, to drive the right track schematically shown at 18, a stick cylinder schematically shown at 19 and a bucket cylinder schematically shown at 20. The combined output of pumps 14 and 15 supplies operating fluid to the left track 21 and the boom cylinder 22. The excavator may also be provided with a swing pump 23 which supplies operating fluid to the hydraulic equipment for swinging the excavator boom laterally, the swing circuit being shown schematically at 24.

Each of the circuits 10 and 11 includes control valve means identified by the reference characters 25 and 26 respectively. A line 27 shown in broken lines in FIG. 1 provides for communication between the output or discharge of the pump circuit 11 and the unloading valve 25. The line 28 provides for communication between the output of pump circuit 10 and the unloading velve 26. The lines 27 and 28 are provided for purposes which will be explained in more detail hereinafter.

Figure 2:
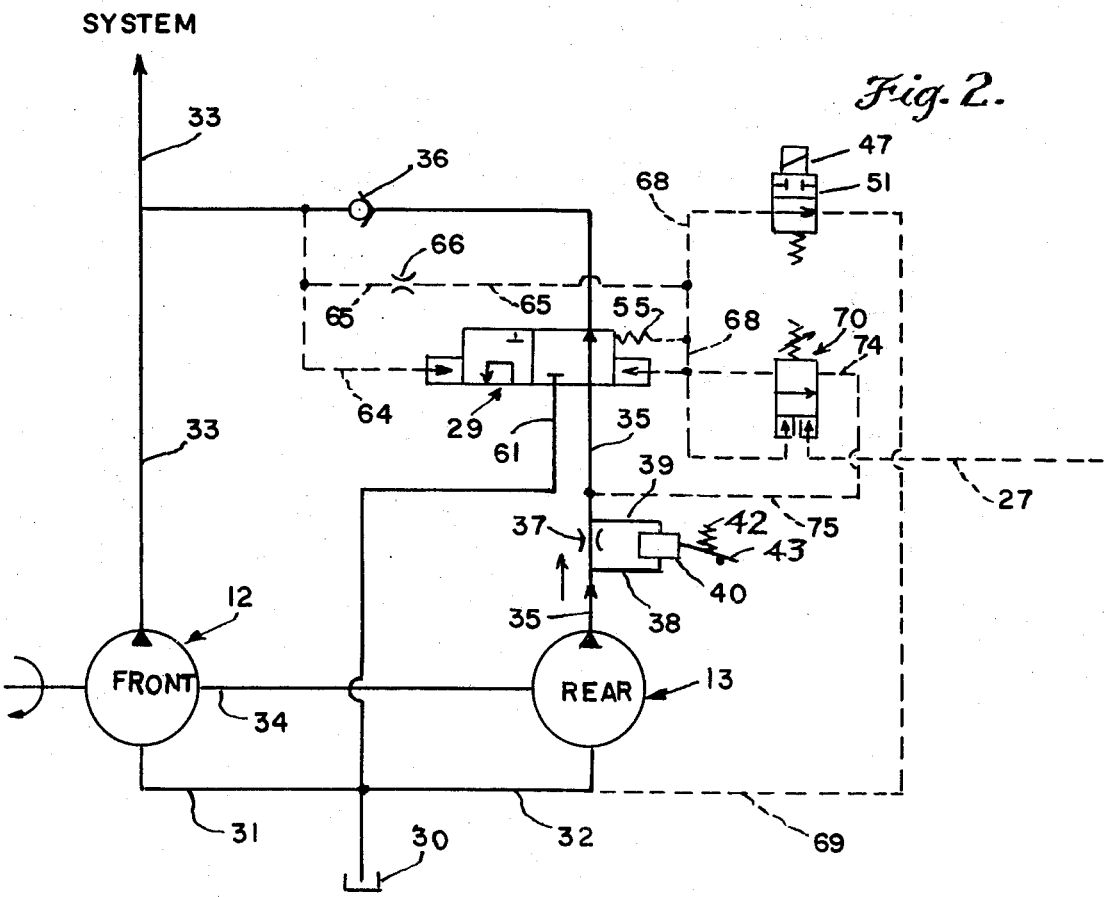
FIG. 2 is a schematic view of one circuit comprising a pair of pumps used in the excavator of FIG. 1.
Figure 3:
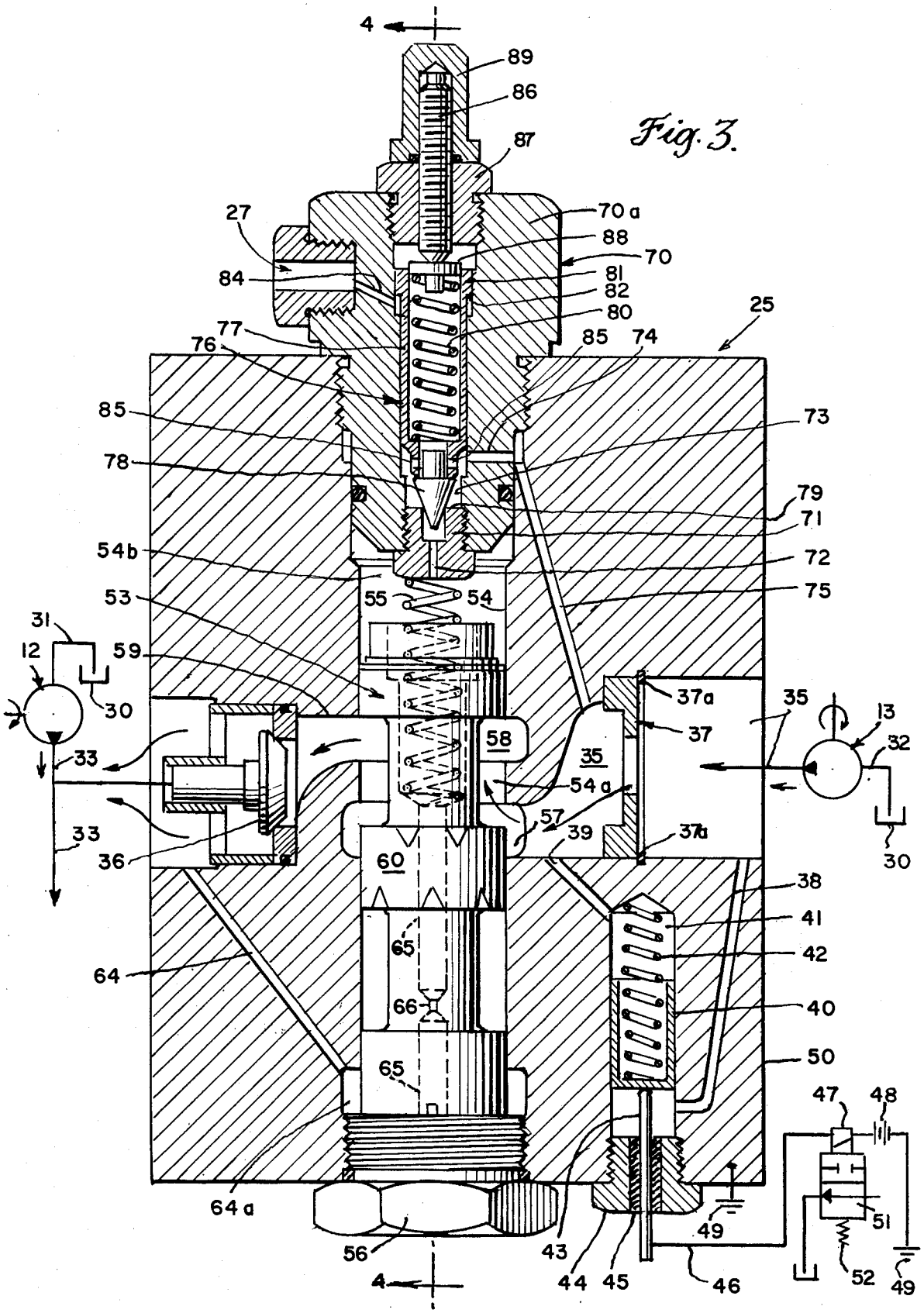
FIG. 3 is a sectional detailed view of control valving shown in schematic form in FIG. 2.
Figure 4:
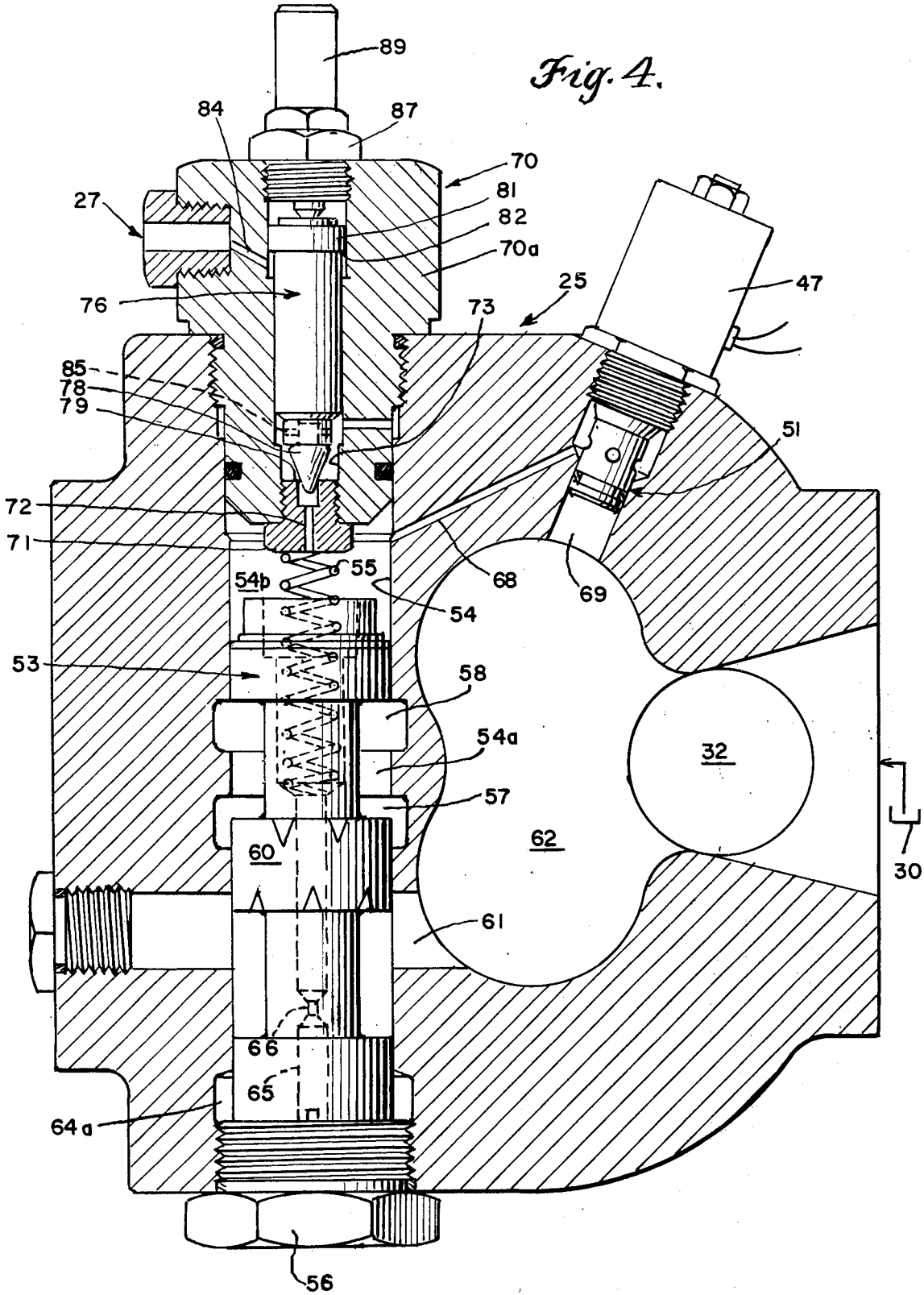
FIG. 4 is a right sectional view of the valving of FIG. 3 taken along the line 4—4 of FIG. 3.

Reference is now made to FIGS. 2–4. FIG. 2 illustrates in schematic form the pumps for the circuit 10 together with a schematic representation of control valve means constructed in accordance with the present invention, whereas FIGS. 3 and 4 are detail views of the valve means. Although not necessary for accomplishing certain important objects of the invention, in the illustrative embodiment, the pumps and control valve means for the circuits 10 and 11 are identical.

In FIGS. 2 and 3, the pumps of the circuit 10 are shown at 12 and 13 as receiving fluid from reservoir 30 via passageways schematically shown at 31 and 32 respectively. Pump 12 discharges fluid under pressure through a passageway 33 which delivers fluid to the operating circuit which, as indicated in FIG. 1 includes the right track 18, stick 19 or bucket 20, depending upon the manipulation of the vehicle controls by means not shown. The two pumps are interconnected by a suitable drive connection represented by the reference character 34 in FIG. 2, so that they are rotated in unison by the prime mover 16.

Fluid discharged by pump 13 flows through a line 35, through control valve means schematically indicated by reference character 29, and a check valve 36 after which it is combined with flow from the pump 12.

The control valve means of the circuit 10 includes speed sensing means which preferably comprises a flow restricting orifice plate 37 mounted in the passageway 35 and secured by a snap ring **37*a* as shown in FIG. 3. Branch passages 38 and 39 lead from passageway 35 on opposite sides of the orifice plate 37, to opposite sides of a pressure responsive piston 40 mounted within a chamber 41 and biased by means of a spring 42 against an electrical probe 43. Probe 43 is mounted in a plug 44 within a sleeve of electrically non-conductive material 45. A lead 46 interconnects the probe with a solenoid 47. The circuit also includes an electrical power source such as battery 48 and a ground connection 49. When piston 40 rests against the probe 43, as occurs at low rates of flow of fluid discharged by pump 13 through passageway 35, an electrical circuit is completed through the piston and valve housing 50, both of which are electrically conductive, to ground so that the solenoid is energized and the valve 51 is open. When the differential pressure across the orifice plate 37 as measured on opposite sides of the piston 40 times the area of the piston exceeds the force of the spring 42, the piston lifts off the probe and the piston switch means comprising the probe 43 and the piston 40 are open and the solenoid 47 is de-energized and the valve 51 is closed. It can be seen therefore that a selection of the proper spring load and piston area can be used to cause the solenoid to be energized at flow rates and hence pump speeds below a predetermined value and de-energized at pump speeds above a predetermined value. Since the pumps are driven by the vehicle engine it will be appreciated that the flow rate of fluid in the passageway 35** is a function of engine speed.

The valve means further comprises a spool valve member 53 which acts in conjunction with the speed sensing means to effect unloading of pump 13. Spool member 53 is mounted within a bore 54 extending generally lengthwise of the valve housing as viewed in FIGS. 3 and 4. Spool member 53 is spring loaded by means of a spring 55 to a position in which it rests against a plug 56 which closes one end of the bore 54. In this position, fluid discharged from pump 13 is directed through passageway 35 to a passageway comprising annular groove 57, a portion of the bore 54 designated **54*a*, annular groove 58 and exits via a passageway 59 in which the check valve 36 is located. Flow from passageway 59 combines with the flow from pump 12** as previously noted.

Spool member 53 is adapted to move upwardly, compressing the spring 55 under conditions to be described presently. In the raised position, in which the spool 53 is moved to the opposite end of the bore 54 from that shown in FIGS. 3 and 4, flow entering the annular groove 57 is diverted by means of land 60 on the spool 53 into a passageway 61 which leads to a chamber 62 which returns the fluid discharged by pump 13 to the inlet of the pump indicated at 32 in FIG. 4. In this position of the valve spool 53, pump 13 is in what may be termed the unloaded condition in which it merely circulates fluid directly back to its inlet. The pump is virtually operating in a no load condition, consuming no vehicle horsepower except a minimal amount required to turn the gears and continuously circulate the operating fluid.

In order to move the spool 53 from the position shown in FIGS. 2–4 to the position in which pump 13 is unloaded, means are provided comprising a passageway 64 to establish communication of pressure between the passageway 59 at a point downstream from the check valve 36 and the lower end or face of spool member 53. Passageway 64 leads to annular groove 64*a* at the lower end of bore 54. A drilled passageway 65 having a restriction 66 extends lengthwise of the spool member 53. In the position of the valve spool 53 shown in FIGS. 3 and 4, the forces acting on the spool 53 are the pressure at the lower end or face of the spool as communicated by the line 64 times the area of the end spool, which force is opposed by the force of spring 55 and the pressure in the bore 54 above the spool 53 times the spool area at the opposite end of the spool. The spool is in the loaded position in which flow of pump 13 is combined with flow from pump 12 when the spring force plus the pressure above the spool times the spool area exceeds the pressure on the lower end of the spool times the spool area at the lower end.

A side passage 68 shown in FIGS. 2 and 4 leads from the chamber portion of the bore 54 designated 54*b* which is located on top of the spool 53, to the solenoid operated valve 51. As indicated above, the solenoid operated valve is normally (at speeds above the critical point) in the closed position blocking the passageway 68. When the valve 51 is opened, under conditions described hereinafter, there is communication from chamber portion 54*a*, through the passageway 68, through the valve 51, and a passageway 69 to the inlet 32 of the pump 13.

The pressure override means preferably comprises a poppet valve assembly 70 shown in FIGS. 2–4. The assembly includes a threaded housing 70*a* which is threaded into a counter bore at the upper end of the bore 54 as may be seen in FIGS. 3 and 4. Poppet valve housing 70*a* is provided with a central bore or chamber 73. A plug 71 having an orifice 72 provides communication between bore 73 and the bore 54. Side passageway 74 shown in FIG. 3 leads from the bore 73 through the housing 70*a* and communicates with a passage 75 which in turn communicates with the discharge passage 35 of pump 13 at a point just downstream from the orifice plate 37.

A poppet valve 76 is slidably fitted within the bore 73. The poppet valve 76 comprises a hollow spindle 77 and a conical element 78 which is adapted to contact a seat 79 in plug 71 and block off flow to bore 73 through the orifice 72. A spring 80 urges the conical element 78 into contact with the seat 79. In the illustrative embodiment, the upper end of the spindle portion of poppet valve 76 is stepped radially outwardly as shown at 81 to provide an annular surface 82 against which pressure communicated via a line 84 is brought to bear.

The poppet valve 76 is also provided with radial passages 85 which provide communication between the bore 73 and the hollow interior of the spindle portion 77. Pressure downstream of the orifice plate 37 is communicated to the bore 73 and to the interior of the poppet spindle via passages 75, 74 and cross passages 85.

The passageway 84 provides communication with a second circuit such as the circuit for the left track and boom shown in FIG. 1 via line 27. Pressure in the second circuit is thus communicated to the annular surface 82 and acts against spring 80 to lift the poppet off its seat. The force with which the poppet valve 76 is seated may be adjustably varied by means of a set screw 86 (FIG. 3) which is threaded in a plug 87 and bears against a plate or cap 88 which fits within the hollow interior of the spindle 77 and bears against the spring 80. A sealing cap 89 fits over the set screw 86.

Spindle 77 may be provided with additional annular surfaces, each of which is in communication with a separate circuit. In this event, the total of pressures in the separate circuits will act to lift the poppet off its seat.

In operation of the preferred embodiment, at pump speeds above the control point, which point represents a pump and hence a prime mover speed of desired setting, the differential pressure across the orifice plate 37, when transmitted through side passages 38 and 39, overcomes the spring force 42 and lifts the piston 40 away from probe 43. In this condition, the solenoid 47 is not energized and the valve 51 is closed. Assuming that poppet valve 76 is seated, as is the case when pump 13 is operated above the critical point, flow from the space above spool member 53 is blocked. In this condition, the pressures above and below the spool member 53 are equal and the spring force of spring 55 acts to keep the spool in lowermost position as shown in FIGS. 3 and 4 against plug 56. Flow from the pump 13 is directed through the passageway 57, 54*a*, 58 and 59 so that it joins the flow from pump 12.

In the event that pump speed drops below the control setting, as for example when the excavator bucket encounters a large rock or other obstruction, differential pressure across the orifice plate 37 drops and if it reaches the point at which piston 40 makes electrical contact with the probe 43, the solenoid 47 is energized to open the valve 51, venting the part of bore 54 which is above spool member 53. The pressure above the spool member is thereby dropped to reservoir pressure and the spool member shifts upwardly compressing spring 55 owing to the relatively higher pressure acting on the lower face of the spool member. It should be remembered that shifting of the spooling to the upper position as compared with the position viewed in FIGS. 3 and 4 causes the pump 13 to be unloaded.

As indicated from the above, poppet valve 77 is moved upwardly under certain conditions of operation to control the position of the spool 53. Because the poppet in the preferred embodiment is connected with at least one other circuit via the lines 84 and 27, the pressure in the other circuit acting against the annular step 80 will urge the poppet off seat 79. Also acting to urge the poppet off its seat is the pressure in the part 54*b* of bore 54 which is communicated to the conical tip of the poppet via the orifice 72. Acting to keep the poppet on its seat are the force exerted by the spring 80 and the pressure in the line 75 which acts interiorly of the hollow spindle portion 77 due to the cross passage 85. The pressure in line 75 prevents opening of the poppet when the pump 13 is loaded but is approximately zero when the pump 13 is unloaded since the discharge of pump 13 is communicating directly with suction.

At times when pump 13 is unloaded, and engine speed increases so as to cause the piston to lift off the probe, thereby de-energizing solenoid 47 to close valve 51, poppet valve 70 acts to prevent the reloading of the pump 13 if the pressures acting to open the poppet are high enough. In the preferred embodiment, these pressures are derived from the secondary circuit (e.g. pressure in circuit 11) and the space 54*b* above spool 53. When the pressures derived from these sources reach a predetermined valve, the poppet is lifted off its seat and communication is established between the space 54*b* and the line 75. Since pump 13 is unloaded, the pressure in line 75 is approximately zero. With the poppet open, the space above the spool 53 drops to a pressure which is low relatively to the pressure acting on the other end of the spool by an amount sufficient to overcome the spring load so that the spool 53 is kept in the raised position as viewed in FIGS. 3 and 4, even though the pump speed is above the critical point.

Since high pressure in line 75 is communicated to the poppet and causes the poppet to be held on its seat when the pump 13 is loaded, the system is in effect pressure responsive only in the unloaded mode. The significance of this is that the pump will not unload so long as the operator keeps pump speed above the set point. Thus the skilled operator can utilize flywheel energy of the prime mover in breaking through obstructions even though the rated horsepower of the vehicle is exceeded. If the operator is not so skilled, the system will operate to prevent overload conditions from developing.

As should be evident, whenever a pump is unloaded, the pressure responsive means acts to prevent reloading of that pump unless and until the pressures derived from the circuits sensed are low enough so that the rated horsepower will not be exceeded should the pump be reconnected to the system. This pressure responsive means is effective even though engine speed is high enough to cause the solenoid operated valve 51 to close so as to prevent repeated cycling which could occur should the sum of the horsepower requirements exceed rated horsepower.

As indicated above, opening of the poppet may be controlled in various ways. The pressures acting to prevent opening of the poppet may be derived from various sources. In equipment having a single hydraulic circuit, the load pressure in that circuit would be the pressure used to control opening of the poppet. In equipment having a plurality of hydraulic circuits the poppet may be made responsive to the sum of the pressures in some or all circuits or if desired may be made responsive to the highest pressure prevailing in any of the circuits.

I claim:

1. In a hydraulic control system including hydraulically operated mechanism and a plurality of pump means driven by a prime mover, means for limiting the torque requirements imposed on said prime mover comprising means for unloading one of said pump means in response to a reduction of the speed of said prime mover below a predetermined value and for reloading said one pump means when the speed of the prime mover exceeds said predetermined value, and pressure responsive over ride means for permitting said reloading of said unloaded pump only when pressure in said system is below a predetermined pressure value and the speed of the prime mover is above a predetermined speed

2. A hydraulic control system of the kind having a pair of operating circuits each including hydraulically operated mechanism, each of said circuits having a fixed displacement pump driven by a rotary prime mover common to both, means for limiting the torque requirements imposed on said prime mover by loads encountered at said mechanisms, said torque limiting means comprising unloading valve means for diverting the fluid delivered by one of said pumps from the mechanism whereby the pump is not under load, means responsive to a reduction in the speed of the prime mover below a preselected speed to cause said valve means to unload said one pump and pressure responsive poppet valve means for preventing reloading of said pump, except when the pressures acting on said poppet valve means are below a preselected value, said poppet valve means having a fluid connection with said other circuit whereby increases in load pressure in the other circuit acts on the poppet valve means in a sense to prevent reloading of said one pump.

3. In a hydraulic control system of the type having a pair of operating circuits each including hydraulically operated mechanism, at least one of said circuits having two pump means, and wherein said pump means are driven by a rotary prime mover common to both circuits, means for limiting the torque requirements imposed on said prime mover by loads encountered at said mechanisms, said last named means comprising a control valve for unloading one of said pump means, flow responsive means responsive to a reduction in the rotational speed of said prime mover below a predetermined minimum speed to operate said control valve so as to unload said one pump means; and means subjecting said control valve to the sum of the pressures existing in said hydraulic circuits, said control valve being effective to reload said one pump means in response to conditions in said circuits such that the rotational speed of said prime mover has increased above said preselected minimum, and the sum of said pressures is not in excess of a preselected limit.

4. A system in accordance with claim 3, and further characterized in that said control valve includes: a spool shiftable, in response to a predetermined pressure difference thereacross, between a position in which flow from said one pump means is diverted from said hydraulically operated mechanism and a position in which flow is delivered to said mechanism; and switching apparatus responsive to the difference in pressure existing at two spaced regions downstream of said one pump means, and which difference in pressure is a function of the rotational speed of said prime mover, to maintain or reduce the pressure existing at one side of said spool above or below said predetermined pressure.

5. A system in accordance with claim 4 in which there is provided a restricted orifice through which flows the fluid derived from said one pump means, and said switching apparatus includes a member movable to open and close an electrical circuit in accordance with the pressure differential existing across said orifice.

6. A system in accordance with claim 5, and further characterized by inclusion of a solenoid valve controlled by said switching device and effective to maintain the pressure existing at said one side of said spool above the predetermined pressure when said solenoid valve is closed, and to reduce the pressure existing at said one side of said spool below the predetermined pressure when said solenoid valve is open.

7. In a hydraulic control system of the type having a pair of circuits each including hydraulically operated mechanism and at least one of which circuits has two pump means driven by a rotary prime mover common to both, means for limiting the torque requirements imposed on said prime mover, said last means comprising means for unloading one of said pump means in response to dropping of the speed of said prime mover below a preselected value, and for conditioning said one pump means for reloading when the sum of the pressure derived from said one pump means, and a pressure existing in said other circuit, is no greater than a predetermined value.

8. In equipment having mechanism for performing a first function and hydraulically operated auxiliary mechanism for performing a second function, a prime mover for operating the mechanism for performing the first function under variable load conditions and hydraulic actuating means for the auxiliary mechanism comprising two fixed displacement pumps connected to be driven by the prime mover at speeds which vary in accordance with the speed of the prime mover, a conduit system through which fluid is delivered by the pumps to the auxiliary mechanism, control means in the conduit system for connecting and disconnecting one of said pumps from the conduit system in accordance with torque requirements imposed on the prime mover, said control means including a device for disconnecting said one pump when prime mover speed drops below a selected value and for conditioning said one pump for reconnection when prime mover speed increases to the selected value, said control means further including a pressure-responsive override for preventing reconnection of said one pump by said speed-responsive device except when pressure in the conduit system is below a selected value.

9. In combination with a pair of hydraulic circuits operable under variable load conditions, at least one circuit including a pair of hydraulic pumps driven by a single prime mover, means for limiting the torque requirements imposed on said prime mover by such variable load conditions, comprising: pressure-responsive control valve means having a part movable to positions in which it unloads and reloads one of said pumps; means associated with said one pump for developing a fluid pressure differential which is a function of the speed of operation of said prime mover; means for subjecting said control valve means to a first pressure developed by said other pump and to a second pressure prevailing in the other circuit; and means for utilizing said pressure differential, when the speed drops below a preselected value, to cause said valve part to move to unloading position, said last named means further being effective to cause said valve part to move to reloading position when the sum of said first and second pressures is below a predetermined level and said speed has returned to said preselected value.

10. A combination in accordance with claim 9, and in which there is provided a restricted orifice through which flows the fluid derived from said one pump, and across which orifice is developed the pressure differential which is a function of the speed of operation of said prime mover.

11. A combination in accordance with claim 9, and in which said means for utilizing said pressure differential includes an electrical switching circuit controlled by the differential fluid pressure, said circuit being effective to cause movement of said valve part in accordance with the control exerted by the differential fluid pressure.

12. A combination in accordance with claim 9, and in which said last means includes: a solenoid valve; a restricted orifice through which flows the fluid derived from said one pump; and switching apparatus having a member movable to control said electrical circuit for opening and closing said solenoid valve, closing of said solenoid valve in response to a reduction in flow to cause said valve part to move to unloading position.

* * * * *

UNITED STATES PATENT AND TRADEMARK OFFICE

CERTIFICATE OF CORRECTION

PATENT NO. : 3,975,909
DATED : August 24, 1976
INVENTOR(S) : James R. McBurnett

It is certified that error appears in the above-identified patent and that said Letters Patent are hereby corrected as shown below:

Column 3, line 52, "velve" should be --valve--.

Column 5, line 36, "54a" should be --54b--.

Column 7, line 8, "valve" should be --value--.

Column 7, line 62, change "over ride" to --override--.

Column 7, line 66, "value." should be added after "speed".

Signed and Sealed this

First Day of March 1977

[SEAL]

*Attest:*

RUTH C. MASON
*Attesting Officer*

C. MARSHALL DANN
*Commissioner of Patents and Trademarks*